US009926713B1

(12) United States Patent
Livingston

(10) Patent No.: US 9,926,713 B1
(45) Date of Patent: Mar. 27, 2018

(54) AUTOMATIC SPA AND POOL COVER REMOVAL DEVICE

(71) Applicant: Lynda M. Livingston, Williamsport, PA (US)

(72) Inventor: Lynda M. Livingston, Williamsport, PA (US)

( * ) Notice: Subject to any disclaimer, the term of this patent is extended or adjusted under 35 U.S.C. 154(b) by 0 days.

(21) Appl. No.: 15/339,852

(22) Filed: Oct. 31, 2016

(51) Int. Cl.
*E04H 4/00* (2006.01)
*E04H 4/10* (2006.01)
*E04H 4/08* (2006.01)

(52) U.S. Cl.
CPC ..... *E04H 4/108* (2013.01); *E04H 4/086* (2013.01); *E04H 4/101* (2013.01)

(58) Field of Classification Search
CPC ..... E04H 4/108; E04H 4/086; E04H 4/101; E04F 10/02; B60P 7/04
USPC ..... 4/498, 580; 296/100.03, 100.02, 100.01, 296/100.05, 100.12
See application file for complete search history.

(56) References Cited

U.S. PATENT DOCUMENTS

RE25,078 E * 11/1961 McGuire ..... E04H 4/101 4/502
3,501,783 A * 3/1970 Broadman ..... E04H 4/082 4/500
4,466,143 A * 8/1984 Lamb ..... E04H 4/101 4/498
4,991,238 A * 2/1991 Forrest ..... E04H 4/084 4/498
5,184,356 A * 2/1993 Lof ..... E04H 4/101 4/498
5,546,972 A * 8/1996 Wardell ..... B60J 7/062 135/119
6,119,758 A * 9/2000 Coenraets ..... E04H 4/101 160/273.1
6,430,879 B1 * 8/2002 Nuiry ..... E04B 1/34305 4/498
6,618,869 B1 * 9/2003 Jacobs ..... E04H 4/101 4/502
7,721,361 B1 * 5/2010 Shubert ..... E04H 4/084 4/494
7,735,163 B2 * 6/2010 Comitino ..... E04H 4/06 135/119
8,066,591 B2 * 11/2011 Zilverberg ..... A47G 27/0206 160/238
8,239,977 B2 8/2012 Sloss
(Continued)

FOREIGN PATENT DOCUMENTS

WO WO 2008/048496 A2 4/2008

*Primary Examiner* — Benjamin R Shaw
(74) *Attorney, Agent, or Firm* — Zale Patent Law, Inc.; James R. McDaniel; Lawrence P. Zale

(57) ABSTRACT

An automatic spa cover for covering a spa is described having a retractable frame, which rides along a top surface of the spa, attached to a front edge of an insulated cover. A motorized cover roller is attached to a back edge of the insulated cover and functions to roll up and retract the insulated cover and pull the frame to slide along the top lip of the spa side walls to retract the frame. In one embodiment, the frame is spring-loaded and extends from its retracted position to its extended position by the force of the springs. In an alternative embodiment, conventional actuation devices may be used to extend the frame. It also includes a retractable angled top cover covering the retractable frame which is supported by a curved guide proximate the motorized cover roller.

14 Claims, 5 Drawing Sheets

(56) References Cited

U.S. PATENT DOCUMENTS

2005/0097834 A1* 5/2005 King ..... E04H 4/101 52/169.7
2007/0101490 A1* 5/2007 Dickie ..... A47K 3/001 4/580
2007/0220666 A1* 9/2007 Diarte ..... E04H 4/086 4/498
2008/0184476 A1* 8/2008 Albert ..... A47K 3/001 4/580
2008/0244820 A1* 10/2008 Moore ..... B63B 17/02 4/498
2009/0025134 A1* 1/2009 Stephens ..... E04H 4/101 4/498
2010/0011498 A1 1/2010 Coleman et al.
2010/0122407 A1* 5/2010 Dewyea ..... E04H 4/101 4/498
2010/0170032 A1* 7/2010 Sproatt ..... E04H 4/101 4/502
2010/0313352 A1* 12/2010 Sloss ..... E04H 4/084 4/498
2011/0308003 A1* 12/2011 Scali ..... E04H 4/082 4/498
2013/0000030 A1* 1/2013 Bradshaw ..... E04H 4/14 4/498
2014/0000021 A1* 1/2014 Scheps ..... E04H 4/101 4/498
2014/0090163 A1* 4/2014 Genova ..... E04H 4/084 4/498
2014/0208501 A1* 7/2014 Black ..... E04B 1/342 4/503
2015/0101116 A1* 4/2015 Stien ..... E04H 4/06 4/498
2015/0284969 A1* 10/2015 Coenraets ..... B60J 7/085 150/154
2016/0123028 A1* 5/2016 Cunerty ..... E04H 4/084 4/498

* cited by examiner

AUTOMATIC SPA AND POOL COVER REMOVAL DEVICE

FIELD

The current invention relates to an automatic SPA cover, and more specifically to an automatic SPA cover which require little effort to operate.

BACKGROUND

Hot tubs and spas (collectively referred to as "spas") are very popular and increasing in popularity. Their increase also increases demand for accessories for the spas, such as covers.

Not only are there more spas, but newer types of spas, such as the swim spas are becoming more popular. Swim spas employ one or more propellers which create a current in the spa. A swimmer can exercise by swimming in place against the current.

Since the swim spas require room to allow the swimmer to swim in place, they can be on the order of 19 feet long. Due to their size and weight, many of these spas are located outside. This introduces other problems.

Since the spas are typically maintained at about 100 Degrees F., and they have a large surface area, they dissipate heat rapidly. This problem is worse outside in fall, winter and spring. Maintaining the heat of the water in the spa can be expensive. Thicker covers insulate better, but are bulky and difficult to spread over the spa.

Also, due to the large open top of the spas, they catch a large amount of leaves, nuts, and other objects which fall into them.

For these and other reasons, it is important to cover them. However, due to their size, it is difficult to manually cover them. Also, due to their size, automatic covers which use lifting mechanisms must be large and powerful due to the size of the spas and leverage involved. This problem is worse when thick insulated covers are used.

Currently, there is a need for an automatic cover for a spa which is not large or bulky, is easy to operate, inexpensive, prevents objects from falling into the spa, and thermally insulates the spa.

BRIEF DESCRIPTION OF SEVERAL VIEWS OF THE DRAWINGS

The above and further advantages may be better understood by referring to the following description in conjunction with the accompanying drawings, in which like numerals indicate like structural elements and features in various figures. The drawings are not necessarily to scale; emphasis instead being placed upon illustrating the principles of the concepts. For example, the dimensions of some of the elements in the figures may be exaggerated relative to other elements to help to improve understanding of various example embodiments. Also, common but well-understood elements that are useful or necessary in a commercially feasible embodiment are often not depicted in order to facilitate a less obstructed view of these various example embodiments.

DETAILED DESCRIPTION

Theory

Regarding the problem of thermal loss described above, it is known that the cover should have sufficient thermal insulation. This thermal insulation adds weight to the cover. Since spas are becoming larger, and since prior art automatic cover designs disclose lifting of the cover off of the spa opening, large and strong devices are required to lift the spa covers due to the leverage.

The force required to lift these covers not only depends upon the size of the cover to be lifted, but also depends upon the weight of the cover. Prior art designs use materials which over time accumulate water. This causes problems of increased weight of the cover.

The current invention solves this problem by using sealed hydrophobic materials which did not accumulate water, and do not increase its weight.

The current invention solves this problem by not lifting the cover off the spa opening, but sliding it along the edges of the spa opening. A retractable frame is designed to slide along an upper surface of the side walls of the spa. The frame may be supported by rollers or wheels, which reduces the force required to extend or retract the frame.

Prior art designs also had problems with water pooling, or the accumulation of debris on top of the flat spa covers. This problem is handled by the current invention by employing a separate angled top cover. This top cover angles from a curved support at the back end of the spa, to a lower front portion of the frame at the front of the spa.

Since the top cover is retracted and draped back behind the spa, any material which does remain on the top cover, dries and is allowed to fall off the cover onto the ground behind the spa.

Figure 1:
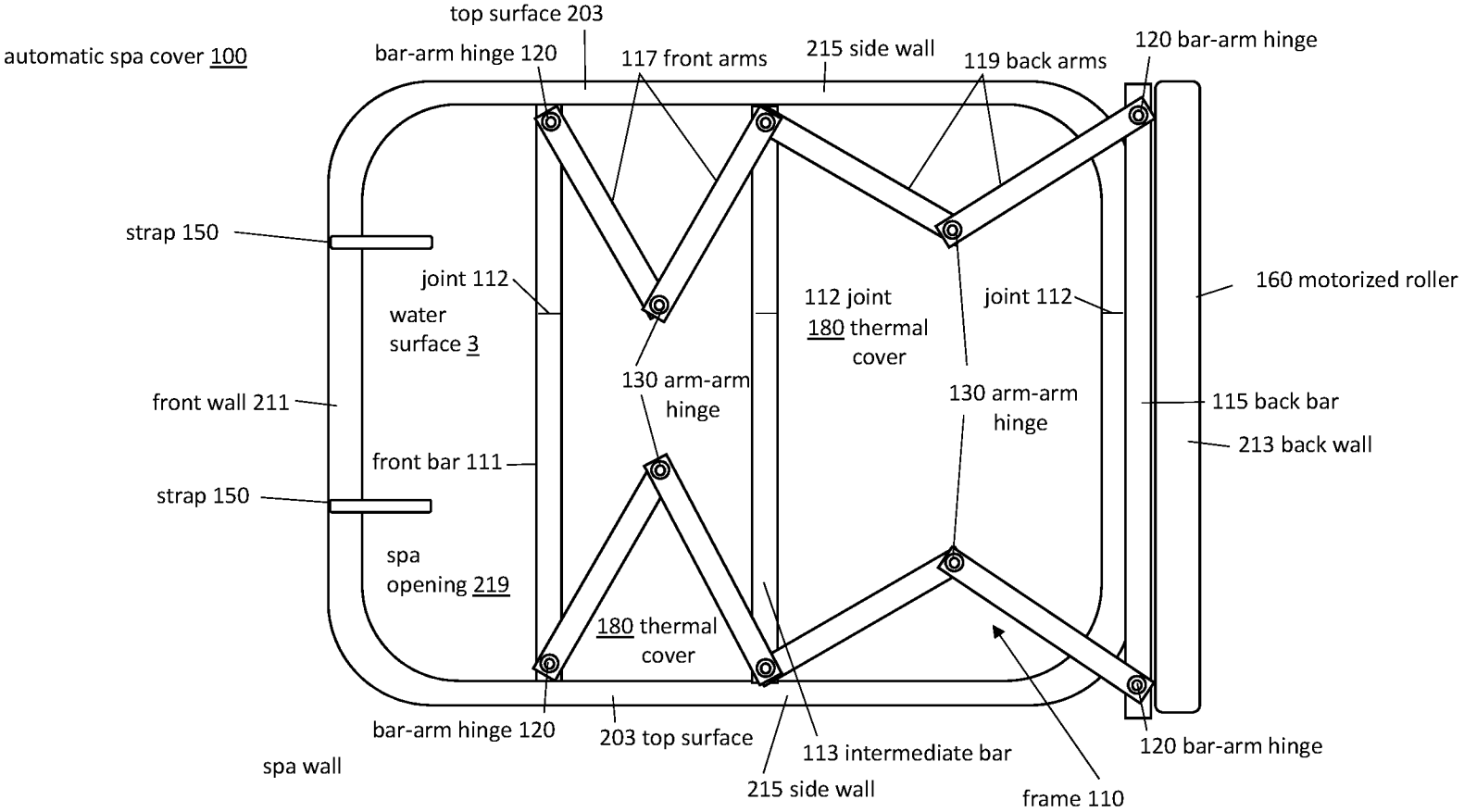
FIG. 1 is a top plan view of one embodiment of an automatic spa cover according to the present invention as it would appear in operation on a spa in its partially open position leaving the spa opening partially open.

FIG. 1 is a top plan view of one embodiment of an automatic spa cover 100 according to the present invention as it would appear in operation on a spa in its partially open position, leaving the spa opening partially open. The top cover and the curved guide are not shown in FIG. 1. They have been removed to show the underlying frame 110 and other structures not visible when the top cover is present. A back bar 115 is fixed with respect to spa 200.

There are 2 back arms 119 connected by an arm—arm hinge 130. The other ends of the back arms 19 are connected to back bar 115 and an intermediate bar 113. In this embodiment, there are 4 back arms 119, 2 on each side of the spa 200. This structure allows the back arms to pivot relative to each other to allow intermediate bar 113 to be closer or farther from back bar 115.

Similarly, there is a front bar 111 and 2 pairs of front arms 117 in this embodiment. Front arms 117 are connected to each other by arm—arm hinge 130 and the free ends of each of the front arms are connected to intermediate bar 113 and front bar 111. The connection of all of the arms to the bars is at a bar—arm hinge 120.

As is shown in FIG. 1, bars 111, and 113 have ends that slide along a top surface 203 of side walls 215 over spa opening 219. The position of frame 110 shows that it is partially open showing the water surface 3.

A front edge of a thermal cover 180 is attached to a front portion of frame 110, being the portion of frame 110 that is closest to the front wall 211. The thermal cover 180 extends under frame 110 to a motorized cover roller 160 mounted near back bar 115. In this embodiment, motorized cover roller 160 is mounted on a support shelf 201 which extends off of the back wall 213 of spa 200.

Motorized cover roller 160 functions to reel in thermal cover 180 when the spa 200 is being open for use. As motorized cover roller 160 reels in thermal cover 180, and also causes frame 110 to fold upon itself with arm—arm hinges 130 moving away from side walls 215 and towards a centerline of spa 200.

Thermal cover 180 is made of insulating material that is hydrophobic, so that it does not absorb or collect water. It is also sealed on both sides with the layer of water proof material to further limit collection of water.

Figure 2:
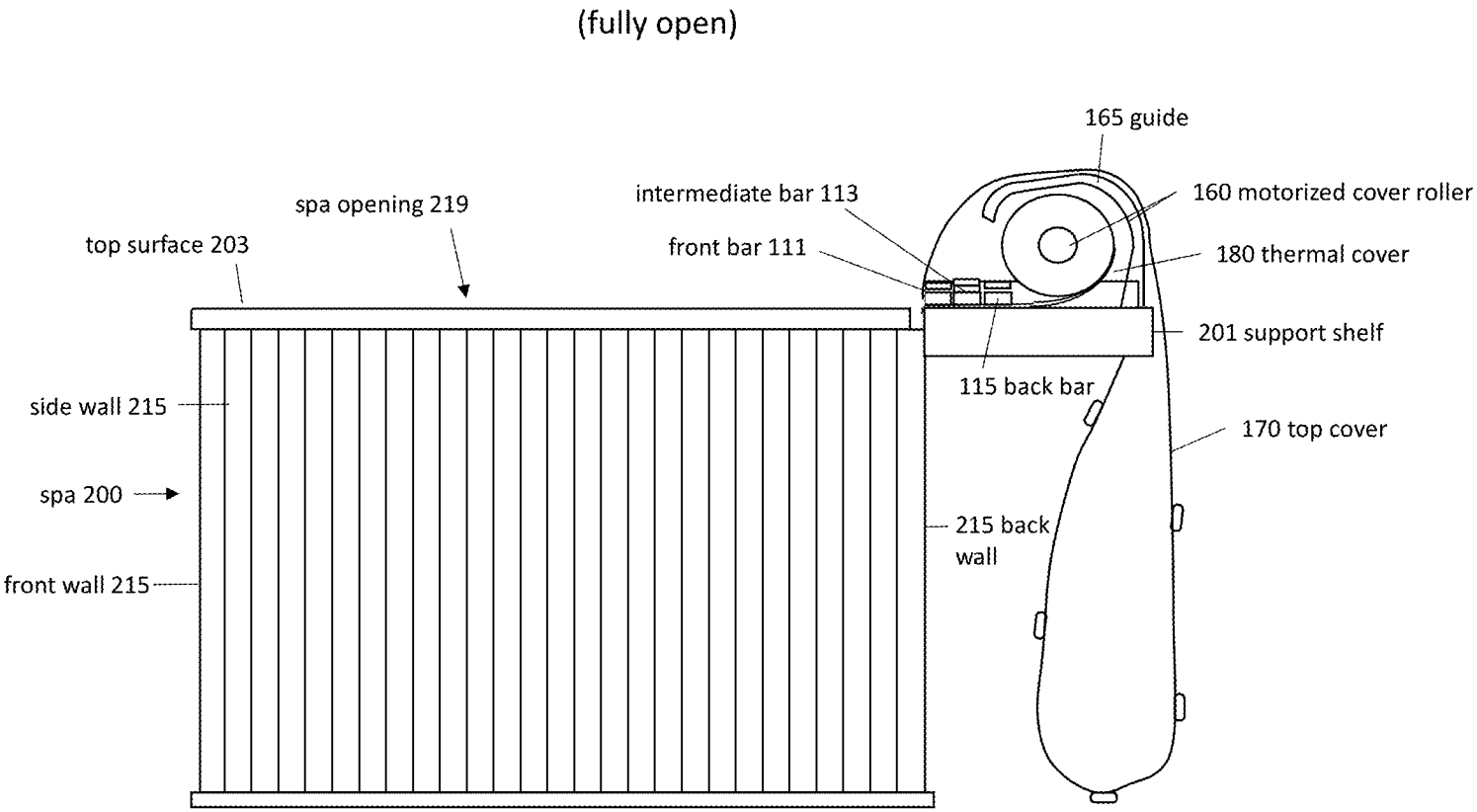
FIG. 2 is a side elevational view of the spa of FIG. 1, showing the automatic spa cover in its fully retracted position leaving the spa opening fully open.

FIG. 2 is a side elevational view of the spa of FIG. 1, showing the automatic spa cover 100 in its fully retracted position leaving the spa opening 219 fully open. In this view, front bar 111, intermediate bar 113, back bar 115 and the rest of the frame are folded together and at least partially rest upon support shelf 201. Motorized cover roller 160 rolls up the thermal cover 180. In doing so, it has retracted the frame. It has also retracted top cover 170 which now hangs down past support shelf 201 into a loop which is connected to the bottom of support shelf 201. As is shown here, a number of weights 171 may optionally be used to cause top cover 170 to begin to fall downward behind spa 200.

A curved guide 165 holds top cover 170 above and away from motorized cover roller 160 and allows top cover 170 to slide over and to hang down below support shelf 201.

Figure 3:
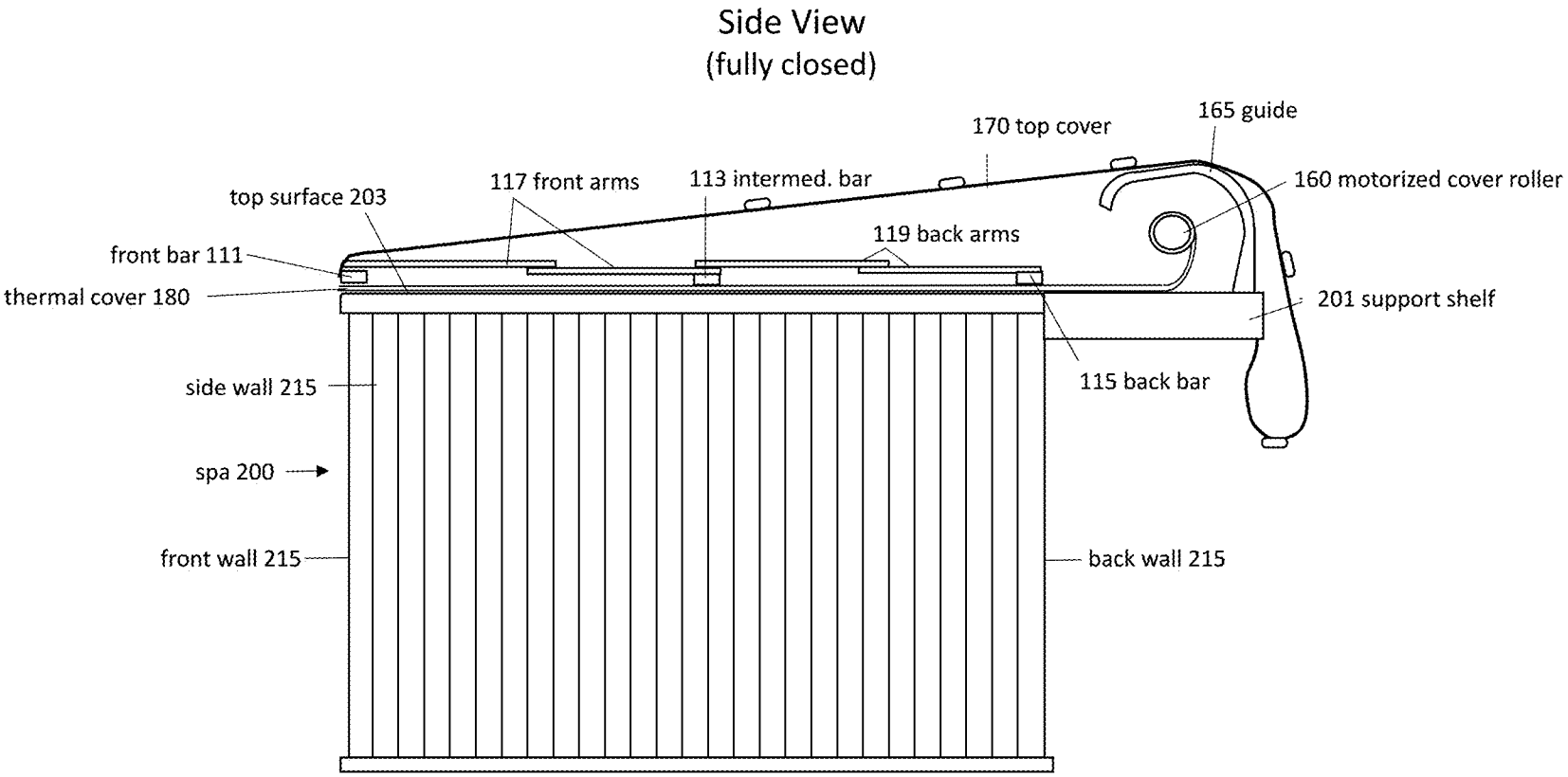
FIG. 3 is a side elevational view of the automatic spa cover of FIGS. 1 and 2 in its fully closed position fully covering the spa opening.

FIG. 3 is a side elevational view of the automatic spa cover 100 of FIGS. 1 and 2 in its fully closed position covering the spa opening 219. In this position the front bar 111, intermediate bar 113 and back bar 115 are shown in their appropriate extended positions. Front arms 117 are shown connecting front bar 111 and intermediate bar 113. Back arms 119 are shown connecting intermediate bar 113 and back bar 115.

Thermal cover 180 is extended out across and covering the spa opening.

Top cover 170 the extends from front bar 111 to curved guide 165 with additional portions extending downward in a loop to connect to the bottom of support shelf 201. A plurality of weights 171 are shown attached to the outside surface of top cover 170. As indicated above, these facilitate and start top cover 170 to fall downward behind spa 200.

Figure 4:
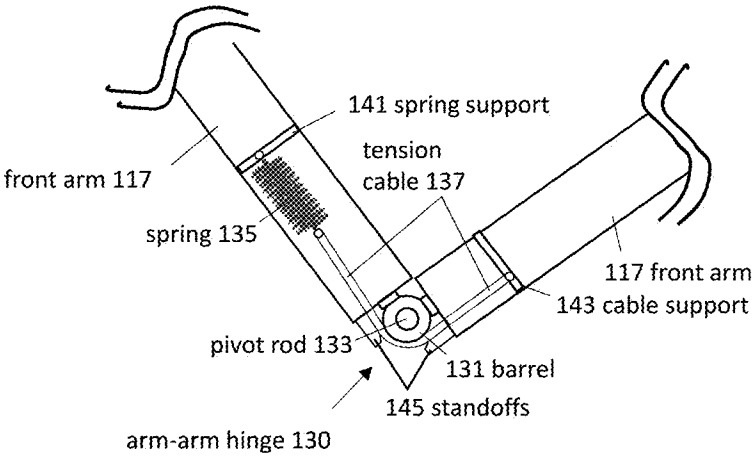
FIG. 4 is an enlarged cut away view of the arm-arm hinge in a flexed position.

FIG. 4 is an enlarged cut away view of the arm-arm hinge 130 in a flexed position. The 2 front arms 117 are connected at arm—arm hinge 130. Arm—arm hinge 130 includes a barrel 131 attached to one front arm 117. The other front arm 117 is attached to another barrel 131. The pivot rod 133 passes through the center of both barrels 131 thereby holding front arms 117 together and allowing them to pivot relative around arm—arm hinge 130.

A spring support 141 is fixed within one front arm 117. A spring 135 is attached to spring support 141. The other end of spring 135 is attached to a tension cable 137. The other end of tension cable 137 is attached to a cable support 143 fixed within the other front arm 117. Tension cable 137 tries to shorten the distance between spring support 141 and cable support 143 thereby urging the front arm 117 to straighten with respect to other front arm 117.

Figure 5:
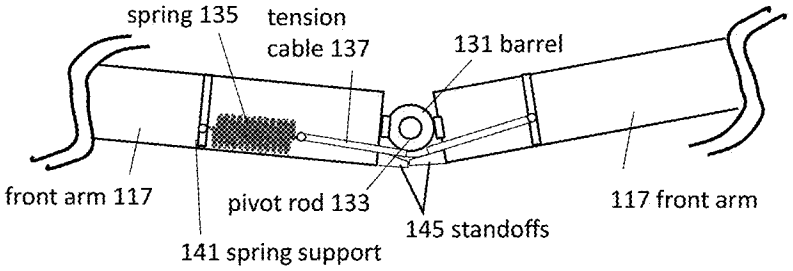
FIG. 5 is an enlarged cut away view of the arm-arm hinge of FIG. 4 in its maximum extension position.

FIG. 5 is an enlarged cut away view of the arm-arm hinge 130 of FIG. 4 in its maximum extension position.

The tension of tension cable 137 urges front arm 117 to straighten with respect to the other front arm set 117. However, arm—arm hinge 130 employs standoffs 145 attached to each front arm 117, protruding into the space between the front arms 117. Standoffs 145 prevent arm—arm hinge 130 from opening to a full 180° or greater angle. This ensures that front arm 117 will not align with the other front arm and lock into place, preventing arm-arm hinge 130 from collapsing when a force is applied to the ends of the front arms 117. This allows the motorized cover roller 160 of FIGS. 1-3 to reel in the thermal cover 180, and cause front arms 117 and back arms 119 to fold at arm-arm hinges 130 and allow the frame 110 to collapse and fold against the back bar 115 in a compact manner.

Figure 6:
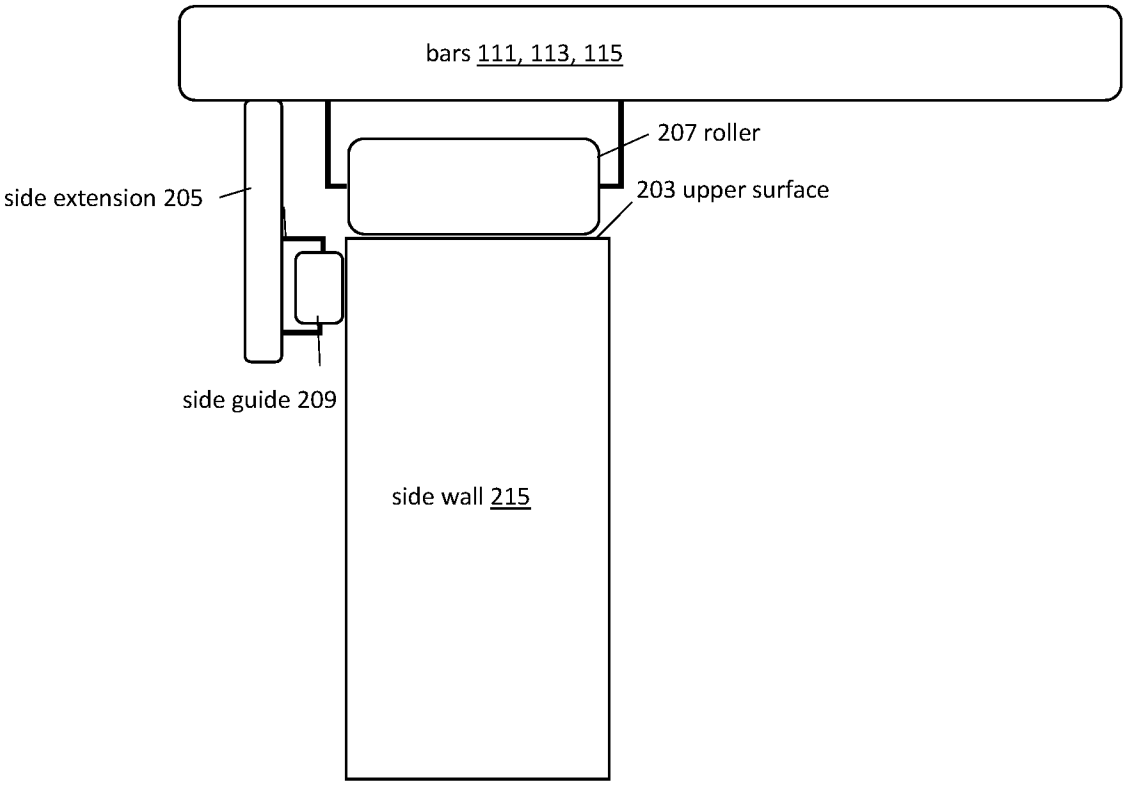
FIG. 6 is an enlarged view of a portion of rollers of the frame in contact with a top surface of a side wall of the spa.

FIG. 6 is an enlarged view showing rollers of the frame in contact with a top surface 203 of a side wall 215 of the spa 200. In order to reduce the force required to extend and retract frame 110, rollers or wheels 207 are mounted between bars 111, 113 115 and top surface 203 of side wall 215. This allows these bars to move easily along top surface 203. Even though this example shows the rollers being mounted below bars 111, 113, 115, they may be attached anywhere underneath frame 110 that moves along top surface 203 of the side walls 215.

FIG. 6 also shows a side extension 205 which extends downward to ride along the outside of side wall 215. This prevents bars 111, 113, 115 from moving to the right causing roller 207 to fall off of upper surface 203. Since there is another side extension 205 on the opposite side of bars 111, 113, 115, it prevents sideways motion of the bar and roller 207 to the left as shown in this figure. Therefore, the side extensions 205 prevent side-to-side motion of the frame, and keep roller 207 on the top surface 203 of side wall 215.

As shown in this embodiment side extension 205 also includes a side guide 209, which in this embodiment is a roller. In other embodiments it may be a solid structure with slides along the outside of side wall 215.

In an alternative embodiment, as shown in FIG. 1, front bar 111, intermediate bar 113 and back bar 115 can each be made of more than one partial bar which attach to each other and meet at a joint 112. The partial bars can be adjusted relative to each other to increase, or decrease their combined length. The thermal cover 180 is also removable or replaceable. By decreasing the width of the partial bars and replacing the thermal cover 180 with a narrower thermal cover, the automatic spa cover 100 can be used on spas of varying width. This allows one design to be used on many different spas. This design makes it less expensive to manufacture, since they will all share the same parts. It also allows a user to use the same automatic spa cover on a new replacement spa.

Although a few examples have been shown and described, it will be appreciated by those skilled in the art that various changes and modifications might be made without departing from the scope of the invention, as defined in the appended claims.

What is claimed is:

1. An automatic spa or pool cover for covering a spa or pool having a front wall, a back wall, a first side wall and a second side wall each with a top surface, comprising:

a. a spring-loaded retractable frame, which rides along a top surface of the spa, wherein springs urge the retractable frame into an extended position;

b. an insulated cover having a front edge connected to a front portion of the retractable frame;

c. a motorized cover roller attached to a back edge of the insulated cover, adapted to roll up and retract the insulated cover and unroll and extend the insulated cover to allow the extendable frame to move toward its extended position; and d. a retractable angled top cover covering the retractable frame.

2. The automatic spa or pool cover of claim 1 wherein the frame has a front bar, a back bar and at least one intermediate bar which are substantially parallel.

3. The automatic spa or pool cover of claim 2 further comprising:

a first arm and a second arm each having a first end and a second end, wherein the first ends are pivotally connected to each other, and the second ends are connected to two adjacent bars.

4. The automatic spa or pool cover of claim 3 wherein the pairs of arms fold, with the hinge connecting them folding inward toward a center of the spa.

5. The automatic spa or pool cover of claim 1 wherein the motorized cover roller is located proximate the back wall of the spa and pulls the front portion of the frame toward the back wall of the spa, retracting the frame.

6. The automatic spa or pool cover of claim 1, further comprising at least one roller supporting the frame and adapted to roll on the spa surface.

7. The automatic spa or pool cover of claim 1, further comprising a side guide restricting motion of the frame in a side-to-side direction across the spa.

8. The automatic spa or pool cover of claim 1, further comprising:

a side guide that employs a roller which rides along a top surface of a side wall of the spa.

9. The automatic spa or pool cover of claim 1, further comprising:

a guide above the motorized cover roller, adapted to hold the top cover higher at the back wall than the front wall at an angle to allow objects, snow and water to roll and slide off of the top cover.

10. The automatic spa or pool cover of claim 2 wherein:

a. the width of the, front bar, back bar and intermediate bars and motorized cover roller are adjustable; and b. the top cover and insulated cover are replaceable.

11. The automatic spa or pool cover of claim 3 wherein the pivotally connected arms comprise:

a hinge that includes at least one standoff to prevent the arms from being fully opened resulting in the arms always being at an angle less than 180 degrees.

12. An automatic spa or pool cover for covering a spa or pool having a front wall, a back wall a first side wall and a second side wall, comprising:

a. a spring-loaded retractable frame which rides along a top surface of the spa, comprising:

i. a front bar extending from one side wall to another side wall of the spa, ii. a back bar substantially parallel to the front bar, iii. at least one intermediate bar being substantially parallel to the front and back bars;

iv. at least one pair of arms pivotally connected to each other and their free ends connecting the back and intermediate bars, v. at least one pair of arms pivotally connected to each other and their free ends connecting the intermediate and front bars;

b. an insulated cover having a front edge connected to a front portion of the retractable frame; and c. a motorized cover roller attached to a back edge of the insulated cover, adapted to roll up and retract the insulated cover and to unroll to allow the spring-loaded retractable frame to urge the insulated cover into an extended position.

13. The automatic spa or pool cover of claim 12 further comprising:

a retractable angled top cover covering the retractable frame.

14. The automatic spa or pool cover of claim 12 further comprising:

a. a plurality of intermediate bars being substantially parallel to the front and back bars;

b. at least one pair of arms pivotally connected to each other and their at least one free end connected to an intermediate bar.

* * * * *